United States Patent [19]

Klaus

[11] 4,186,862

[45] Feb. 5, 1980

[54] DEBRIS COLLECTING MECHANISM FOR PNEUMATIC DRIVING TOOLS

[75] Inventor: Arthur Klaus, Bad Homburg von der Hohe, Fed. Rep. of Germany

[73] Assignee: Signode Corporation, Glenview, Ill.

[21] Appl. No.: 885,544

[22] Filed: Mar. 13, 1978

[30] Foreign Application Priority Data

Apr. 22, 1977 [DE] Fed. Rep. of Germany ..... 2718070

[51] Int. Cl.[2] ..... B25C 1/04

[52] U.S. Cl. ..... 227/130; 227/156

[58] Field of Search ..... 227/112, 130, 156

[56] References Cited

U.S. PATENT DOCUMENTS

| | | | |
|---|---|---|---|
| 2,445,674 | 7/1948 | Kendall | 227/112 |
| 3,429,013 | 2/1969 | Pabich et al. | 227/156 |

*Primary Examiner*—John McQuade

*Attorney, Agent, or Firm*—Dressler, Goldsmith, Clement, Gordon & Shore, Ltd.

[57] ABSTRACT

A mechanism for collecting debris generated during the driving of a fastening means from a strip of such fastening means. The mechanism consists of a container disposed adjacent the opening of the outlet of the driving tool and air means for directing debris from the outlet of the driving tool into the container.

9 Claims, 2 Drawing Figures

16
27
26
17
25
24
12
10
23
22
21
18
8
9

DEBRIS COLLECTING MECHANISM FOR PNEUMATIC DRIVING TOOLS

This invention relates to a debris collecting mechanism for pneumatic driving tools having a magazine adapted to accept fastening means joined together as a strip by connecting means and with a driving plunger for ejecting the fastening means individually from the outlet of a barrel.

In accordance with the prior art fastening means, such as for example nails, screws, staples, cleats, pins, etc., to be handled by such driving tools are joined together in strips, which are supplied from the magazine of the respective driving tool into a driving channel, in which a driving plunger separates the respectively foremost fastening means from the strip and drives it into a workpiece.

The joining together of the fastening means to form strips suitable for the magazines of driving tools is carried out with different types of adhesives and cements as, for example, paper tape coated with a thermo-adhesive, plastics strips, or the like. More particularly, in the case of nails with proud nail heads, there is an increased need to arrange filling members between the nail shanks in order to give the nail strips the necessary degree of stability. During the driving process, remnants of these strip-like connecting means as, for example, adhesive residues, parts of paper tapes, plastics parts, and remains of fillers, are largely torn off from the fastening means and they emerge in debris fragments, whose size is often only in the order millimeters, simultaneously from the barrel of the driving tool. The emergence of these strip joining materials, that is to say, of the parts left over from the strip in a form suitable for use in a magazine during the driving process, often occurs with a very high speed and fragments of material bounce back from the work and may not only be flung against the hands and the face of the operator, but may also strike other persons nearby. As a result, eye injuries may easily be caused and for this reason the wearing of protective goggles is required. Furthermore, these debris remnants from the joining means not only damage the work, but also clutter up the surroundings of the tool. Such residues have a very disadvantageous effect on floors, since as has been found from experience, even a slight fouling of floors, made of asphalt tiles, flags or cast cement, or the like, by such debris leads to a considerable increase in the danger of slipping and sliding.

The aim of the invention is that of creating debris collecting mechanism for pneumatic driving tools, which brings about a scavenging and collection of remnants of material, previously holding the fastening means together, during the driving operation takes place.

A mechanism meeting this requirement is characterized in accordance with the invention by a box, adapted to be mounted at the barrel of the driving tool and which at a small distance from the lower side of the barrel has a rigid bottom in which there is arranged an opening which is opposite to the outlet of the barrel and makes possible the passage of a fastening means and by a pressure line, connected with the main control valve of the driving tool, and which opens laterally into the spacing cavity, delimited by the bottom of the box, under the barrel, and the box is provided with a number of small air passage openings.

When a driving tool equipped with the debris collecting mechanism in accordance with the invention is used for driving a fastening means into work, compressed air flows with a high speed into the spacing cavity between the lower side of the barrel and the bottom of the box, and the directions of movement of the compressed air and of the fastening means are substantially perpendicular to each other. The remnants of material previously holding the fastening means together and now detached from the strip located in the magazine are therefore conveyed by the compressed air into the box. Since the box is provided with a number of small openings it is possible for compressed air to escape from it while the remnants of material used for holding the strip together are on the other hand retained and collected. When the box is full of such remnants it can then either be emptied or replaced by another box.

In accordance with the particularly advantageous embodiment of the mechanism in accordance with the invention there is the provision that the box consists of a container rest, mounted adjacent to the barrel of the driving tool and of a container adapted to be inserted into the container rest and the latter forms the bottom and delimits the spacing cavity with which the container is connected.

In this case, the filled container only needs to be removed from the container rest which itself does not have to be removed from the driving tool.

The container can in this respect consist of cardboard which has small holes in it. It is also possible, however, to make the container of an air-permeable material which owing to its porosity acts as a filter.

In both cases it is convenient if the container is connected detachably with the container rest by means of a catch means, so that the container cannot fall out unintentionally.

In accordance with an advantageous form of the invention, there is the feature that the container is provided at its opening, leading into the container rest, with a lug and in that on the bottom just in front of the lug an abutment is arranged. In cooperation with the abutment, the lug acts as a sort of check valve so that compressed air and remnants of material holding the fastening means together can pass into the container, but, on the other hand, a return into the spacing cavity underneath the barrel is prevented.

As regards the direction of flow of the compressed air, it is convenient if the compressed air line opens into the spacing cavity on the side opposite to the lug of the container.

In the case of an embodiment which is particularly convenient as regards the arrangement of the container on the driving tool, there is the feature that the container rest is arranged underneath the magazine of the driving tool, has a triangular profile, and is open on the side remote from the barrel. In this case, the flat bottom of the container rest rests on the work and the container can be inserted into, and removed laterally from, the container rest.

In accordance with a further additional feature, it has been found effective if the venting opening of the driving tool is closed, and in this case the whole of the compressed air, which has entered the working pressure space during the working stroke, flows via the pressure line and the spacing cavity into the container after reversing the main control valve and the end of the return stroke. Any further remnants of material used for joining in fastening means to form a strip are completely transported into the container.

The invention will now be described with reference to a specific embodiment shown in the drawings, in which:

FIG. 1 shows a conventional pneumatic driving tool 1 for nails, whose individual features accordingly do not necessitate any detailed explanation. At any event, the invention can be used with differently constructed driving tools.

Figure 1:
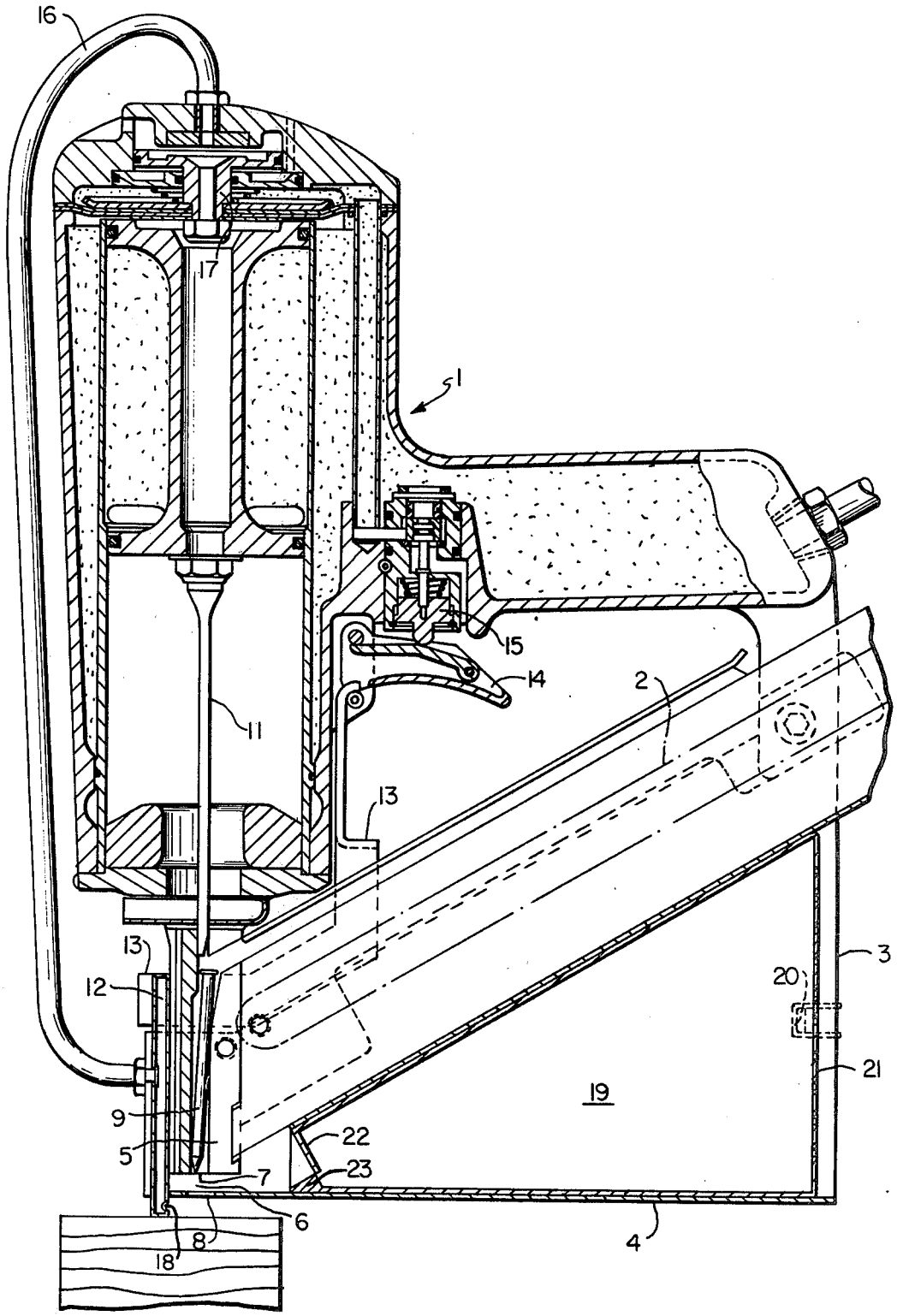
FIG. 1 shows a section through a debris collecting mechanism in accordance with the invention, which is mounted on a pneumatic driving tool for nails, which is in a condition shortly before the beginning of a driving operation.

On the driving tool 1, beneath the nail magazine 2, there is a container rest 3, whose bottom 4 extends as far as a position underneath the stub barrel 5 of the driving tool 1 while the sidewalls of the container rest 3 encompass the barrel 5 as far as the upper edge of the magazine 2. Between the lower edge of the barrel 5 and the bottom 4 of the container rest, there is a spacing cavity 6 having a size of preferably 3 to 4 mm. The bottom 4 is provided with an opening 8 precisely below the outlet of the barrel 7 and this opening 8 permits the passage of a nail 9 with a head 10 and the driving plunger 11 during the driving operation. In front of the muzzle of the barrel 5 there is a rectangular hollow body 12 arranged so that it can slide vertically. This body 12 is fixedly connected with a conventional security device 13 which is only enabled when the driving tool is placed against the work. In cooperation with the trigger 14 this security device 13 initiates the driving operation via the valve 15. The hollow body 12 is connected via a flexible pressure line 16 with a conventional main control valve 17 of the driving tool 1. At the lower side, adjacent to the barrel 5, of the hollow body 12, openings 18 are provided, which are directed into the spacing cavity 6 between the barrel 5 and the bottom 4. In the rear part of the container rest 3, a triangular container 19 of thin cardboard, or the like, is inserted from the rear and is held against falling out by a catch means 20. The rear wall 21 of the container 19 is provided with a large number of small openings or it consists of an air-permeable material. At the front tapering end of the container 19, there is a lug 22, which is directed downwards and which so makes engagement with a projection 23 of the container 19 arranged on the bottom 4 so that the container is closed.

Figure 2:
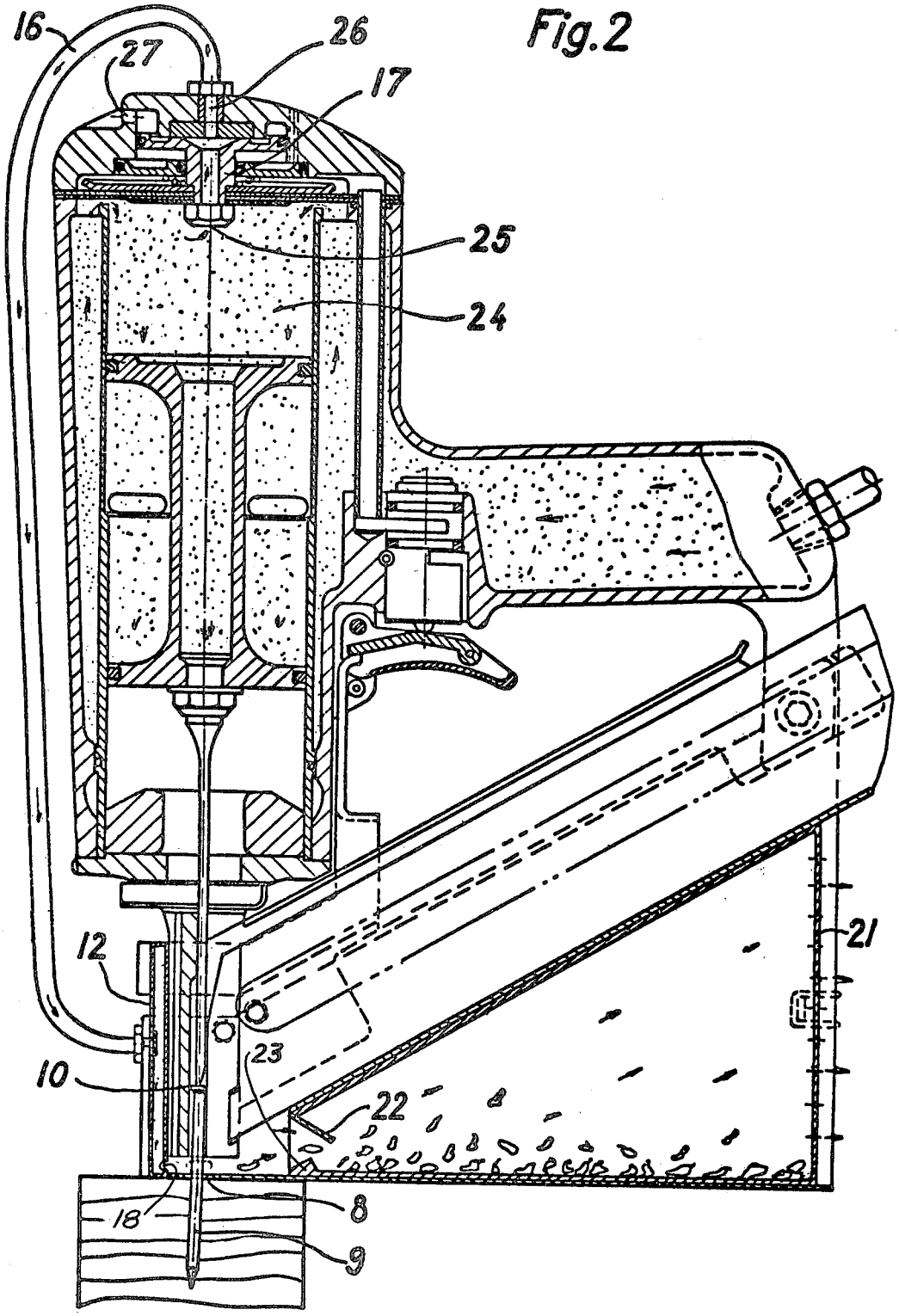
FIG. 2 is a view similar to that of FIG. 1 in the case of which, however, the driving tool is shown during the driving operation.

FIG. 2 shows the driving tool 1 during the driving operation which is started by the cooperation of the security means 13, the trigger 14, the valve 15, and the main control valve 17. When the operation takes place, a part of the compressed air coming into the cylinder space 24 passes via the holes 25 and 26 of the main control valve 17 into the pressure line 16 and the hollow body 12 and a strong scavenging air current flows through the spacing cavity 6 and this air moves past the nail 9 to be driven during the whole of the driving operation in a direction transverse with respect to the direction of driving. As a result, debris, or remnants of material used for holding the fastening means together in the strip and remaining in fragments on the nail shank are cleared of the latter and swilled through the spacing cavity 6 over the projection 23 and past the lug 22, which is opened by the pressure of the flowing air to the rear into the container 19. As a further additional feature, it has been found advantageous to close the conventional venting opening 27 of the driving tool and in this case, the whole of the compressed air which has passed into the working pressure space 24 during the working stroke flows after the switching over of the main control valve 17 and the end of the return stroke via the holes 25 and 26, the pressure line 16, the hollow body 12, the openings 18 at the cavity 6 into the container 19 and any remnants of joining material still present will be completely transported into the container 19. The compressed air can escape to the atmosphere through the small openings in the rear wall 21 of the container 19, while the remnants remain in the container 19. The container 19 can, as soon as it is filled up, be removed after undoing the catch means 20, from the container rest 3, emptied and used again, or it can be thrown away in the filled condition and replaced by a new one.

The container for the collection of the remnants can also be in the form of a bag, or the like. This container does not necessarily have to be arranged below the magazine, and it can also be provided at any other suitable position on the driving tool.

Departing from the embodiment shown, the basic principle of the invention can also be embodied in a construction in which the remnants of material connecting the fastening means to form a strip are not blown out of the spacing cavity by compressed air but drawn off by vacuum. The vacuum necessary for this can conveniently be produced by a Venturi having the compressed air of the driving tool passing through it.

It is, of course, intended to cover by the appended claims all such modifications that fall within the true spirit and scope of the invention.

What is claimed is:

1. A pneumatic fastener driving tool having an outlet barrel, a magazine containing a strip of adhered fasteners and a driving plunger positioned to engage sequentially a fastener at the end of each strip for ejecting an individual fastener from the outlet barrel, a container mounted adjacent the barrel of the driving tool, which container defines an opening adjacent the barrel outlet, conduit means containing air under pressure received from the driving tool, one end of which conduit means is in communication with the end of the barrel through which a fastener moves, whereby air under pressure flows across the barrel and into the opening of the container to direct from said barrel into the container any particulate matter broken off from the fastener strip during the driving action.

2. A mechanism in accordance with claim 1 in which the fastener driving tool defines a platform mounted adjacent the barrel and the container positioned to receive the debris from the fastener strip is disposed on said platform.

3. A mechanism in accordance with claim 2 in which the container defines minute openings at one side thereof, whereby the air introduced into the container can escape without permitting escape of the particulate matter.

4. A mechanism in accordance with claim 2 in which the container is made of an air permeable material.

5. A mechanism in accordance with claim 2 in which the container is provided with locking means for detachably securing the container to the platform on which it is disposed.

6. A mechanism in accordance with claim 2 in which the container includes a valve whereby the container is closed until the introduction of air, at which time the valve is opened by the air pressure to admit air and particulate matter thereinto.

7. A mechanism in accordance with claim 6 in which the conduit means is located on the side of the barrel opposite to the valve in said container.

8. A mechanism in accordance with claim 2 in which the container is generally triangularly shaped and is disposed between the magazine for the driving tool and the platform on which it is located.

9. A mechanism in accordance with claim 1 in which the conduit means is constructed and arranged to only receive air under pressure during the driving action of the fastener.

* * * * *